United States Patent [19]

Gorman

[11] Patent Number: 4,641,705

[45] Date of Patent: Feb. 10, 1987

[54] MODIFICATION FOR HEAT EXCHANGERS INCORPORATING A HELICALLY SHAPED BLADE AND PIN SHAPED SUPPORT MEMBER

[76] Inventor: Jeremy W. Gorman, 5 Cedar Hill Rd., West Simsbury, Conn. 06092

[21] Appl. No.: 747,965

[22] Filed: Jun. 24, 1985

Related U.S. Application Data

[60] Division of Ser. No. 522,033, Aug. 9, 1983, Pat. No. 4,564,066, Continuation-in-part of Ser. No. 287,491, Jul. 29, 1981, abandoned.

[51] Int. Cl.[4] ..... F28F 13/02

[52] U.S. Cl. ..... 165/85; 165/109.1; 165/174; 366/339

[58] Field of Search ..... 165/85, 94, 95, 109 T, 165/174; 138/38; 366/339; 15/104.06 R

[56] References Cited

U.S. PATENT DOCUMENTS

| | | | |
|---|---|---|---|
| 431,574 | 7/1890 | Gaunt | 165/174 |
| 600,910 | 3/1898 | Elmendorf | 165/95 |
| 740,655 | 10/1903 | Hornbrook | 165/174 |
| 1,006,363 | 10/1911 | Beers | 165/95 |
| 1,668,577 | 5/1928 | Vecchio | 165/95 |
| 1,769,808 | 7/1930 | Stancliffe . | |
| 1,783,844 | 12/1930 | Jacobsen | 165/94 |
| 1,838,043 | 12/1931 | Sherwood | 165/145 X |
| 2,039,796 | 5/1936 | Hiller | 165/94 X |
| 2,068,955 | 1/1937 | Kritzer et al. | 165/174 X |
| 2,070,427 | 2/1937 | Faunce | 165/95 X |
| 2,117,175 | 5/1938 | Kaster | 165/94 X |
| 2,210,031 | 8/1940 | Greene | 165/109 T X |
| 2,532,179 | 11/1950 | Miller | 165/95 X |
| 2,877,993 | 3/1959 | Hudachek | 165/94 X |
| 2,943,845 | 7/1960 | Jaklitsch . | |
| 3,407,871 | 10/1968 | Penney | 165/85 |
| 4,174,750 | 11/1979 | Nichols | 165/94 |
| 4,502,509 | 3/1985 | Spitz | 165/109 T X |

FOREIGN PATENT DOCUMENTS

| | | | |
|---|---|---|---|
| 296285 | 2/1916 | Fed. Rep. of Germany | 165/174 |
| 0151802 | 11/1981 | Fed. Rep. of Germany | 165/95 |
| 0207642 | 3/1984 | Fed. Rep. of Germany | 165/95 |
| 0212321 | 8/1984 | Fed. Rep. of Germany | 165/95 |
| 2269054 | 11/1975 | France | 138/38 |
| 319626 | 3/1929 | United Kingdom | 138/38 |
| 347904 | 5/1931 | United Kingdom | 165/85 |
| 1010471 | 11/1965 | United Kingdom | 165/174 |

*Primary Examiner*—Sheldon J. Richter
*Assistant Examiner*—Randolph A. Smith
*Attorney, Agent, or Firm*—Robert S. Smith

[57] ABSTRACT

A tube-and shell double-pipe or liquid-air fin type heat exchanger, which offers a high level of thermal energy transfer efficiency, incorporates a rotary blade to disrupt a fluid film on surfaces of each tube, and is of uncomplicated design and construction. The blade is free-floating and operates regardless of the direction of flow of the liquid through the tubes.

1 Claim, 13 Drawing Figures

MODIFICATION FOR HEAT EXCHANGERS INCORPORATING A HELICALLY SHAPED BLADE AND PIN SHAPED SUPPORT MEMBER

RELATED APPLICATIONS

This application is a division of application Ser. No. 522,033 filed Aug. 9, 1983 which was a continuation-in-part of application Ser. No. 287,491 filed on July 29, 1981, now abandoned. U.S. Pat. 4,564,066 issued on Jan. 14, 1986 based on application Ser. No. 522,033.

BACKGROUND OF THE INVENTION

The remarkable increases in energy costs over the last decade have induced a great deal of developmental effort in conserving energy and more effectively using the energy already available. Almost every device which either generates or utilizes heat energy utilizes some device for transferring heat from where it is generated to where it is to be used. These devices, called heat exchangers, come in a great variety and can involve transferring heat from gases to other gases, gases to liquids, liquids to gases, liquids to liquids, and solids to or from either liquids or gases. The physical characteristics vary widely to adapt to the media (solid, liquid or gas) involved.

Heat exchangers have been known and manufactured for over a century and certain common factors include cooperation with two bodies of different temperatures which are disposed to facilitate the flow of heat from the hotter to the cooler body. In those situations involving two fluids, there is normally a solid barrier between them to prevent intermixing of the two fluids, since if mixing were allowable, a heat exchanger would be unnecessary.

Certain common principles apply to all heat exchangers involving two different fluids. It has long been recognized that, since fluids are good insulators, the transfer of heat requires movement.

Among the factors that affect the efficiency of such heat exchangers is the nature of liquid flow through the unit. In particular, the existence of stagnant films and laminar flow patterns inhibit heat transfer, the effect being especially pronounced in the case of viscous fluids flowing relatively slowly through tubes. It will be appreciated that such conditions will typically exist in the case of shell-and-tube type heat exchangers or double pipe heat exchangers in which one fluid is viscous. In such circumstances, the fluid being heated will, of course, withdraw thermal energy from the hot fluid, thereby cooling the latter and making it more viscous, thus increasing the likelihood that laminar flow patterns and stagnation will occur. This effect is most pronounced at the wall of the barrier between the fluids.

As is well known, devices have been developed for the purpose of inducing turbulent flow, and thereby mixing the fluid as it moves through the heat exchanger. For example, so-called "turbulators" may be fixedly mounted within tubes to produce directional changes, and hence turbulence, in the flowing liquid. Devices for wiping or scraping the walls of the tubes have also been proposed in the interest of disrupting stagnant layers, and are disclosed, for example, in U.S. Pat. Nos. 3,407,871, to Penney, and 4,174,750, to Nichols. However, such devices as are presently known tend to be complex and cumbersome, relatively difficult to install, and limited in their flexibility of application; they may also require an inordinate amount of maintenance.

Many even require an outside source of mechanical energy. To an extent, the complexity of such prior devices may be attributed to efforts to minimize friction in the mounting means so as to facilitate rotation, and thereby render them most effective and efficient in terms of power consumption. This, in turn, increases the cost and difficulty of producing and installing such devices and, to that extent, offsets the advantages afforded thereby. The configurations also limit the application to a specific type of heat exchanger- such as a shell-and-tube heat exchanger or a double pipe heat exchanger, but not both. They further limit the application to new construction, since a retrofit modification of an existing heat exchanger would require custom machine hardware of high cost and costly design.

Accordingly, it is a primary object of the present invention to provide a novel method of creating a heat exchanger having means for preventing stagnation of the fluid against the walls of the tubes through and around which it flows, thereby maximizing the efficiency of thermal energy transfer regardless of the type of heat exchanger, or whether it is an existing or yet-to-be-built heat exchanger.

It is also an object of the invention to provide such a heat exchanger wherein the foregoing advantages are achieved in a manner that is simple, inexpensive and convenient, and in which the need for maintenance is minimized.

Yet another object of the invention is to provide a heat exchanger of the foregoing nature, wherein the wiping effect is independent of the direction of flow of the liquid through the tubes, thereby minimizing difficulty of installation, permitting backflushing of the system in which it is employed, and facilitating the incorporation of such features into single, double and multiple pass units, as well as double pipe heat exchangers.

Yet another object of this invention is to simplify any bearing or anti-friction mechanisms so that a retrofit device can be fashioned for existing heat exchangers, be they single pass, double pass, multipass, or double pipe heat exchangers. To secure maximum effectiveness, special construction is to be avoided and add-on capabilities must be available for existing operating units.

SUMMARY OF THE INVENTION

It has now been found that certain of the foregoing and related objects of the present invention are readily attained in a heat exchanger comprising, in combination, a shell having an inlet and an outlet for passage of a heat exchange fluid therethrough, and at least one tube. The tube is mounted within the shell for external contact by the heat exchange fluid, and is adapted for passage of a heat exchange liquid therethrough in physical isolation from the heat exchange fluid. A generally helical blade is disposed within the tube for free rotation and free axial movement, the blade having a pointed portion on at least one of the ends thereof, and being of such a diameter as to cause the blade to pass in closely spaced relation to the inside surface of the tube during rotation.

The heat exchanger also includes a bearing member which is mounted adjacent one end, which ordinarily will be the exit end portion of the blade, and in closely spaced relationship to the corresponding end of the tube. As a result, passage of the heat exchange liquid through the tube toward the exit end of the blade will cause the blade to rotate within the tube, with the one end portion thereof bearing upon the bearing member. This, in turn, will cause the blade to effectively remove and subsequently mix any stagnant layer or laminar film of the heat exchange liquid that might otherwise tend to form adjacent the inside surface of the tube and impede the flow of heat. The removal of this "heat barrier" will thus promote efficient heat transfer between the heat exchange liquid and the heat exchange fluid through the wall thereof.

In preferred embodiments of the heat exchanger, the blade has a laterally centered pointed portion on both of its ends, and a bearing member is mounted in closely spaced relationship to each end of the tube. The distance between the bearing members is greater than the length of the blade, thus permitting the blade to shift axially in the tube so as to cause it to bear upon either of the bearing members. Although not critical, this "shift" with reversing flow should ideally be about equal to the radius of the tube in which the blade is inserted. Hence, the blade can rotate in either direction, and can function to mix any fluid layer disposed along the inside of the tube.

In some embodiments a bearing pin may be provided within the tube. The bearing pin has a head which cooperates with the pointed end of the blade.

Generally, the heat exchanger will include a multiplicity of tubes mounted on parallel axes within the shell, with each of the tubes containing a helical blade of the nature previously described. In such a case, the tubes will normally all be of substantially the same length, and mounted with their corresponding ends disposed in a common plane. Substantially flat bearing members will be employed therewith, and they will be mounted outwardly of the tubes with the axes thereof normal thereto. For especially efficient operation, the heat exchanger may be configured to function in a double-pass mode, for which purpose it will include, at one end of the bundle of tubes, means for defining a liquid inlet to certain tubes and for defining an outlet from the remainder thereof. At the opposite end, means will be provided for establishing liquid flow between the tubes, thus permitting the liquid to flow twice through the length of the heat exchanger.

In certain very large heat exchangers, or in U-tube or bent tube heat exchangers, the tubes are not straight, but are bent. In such devices each such bent tube shall have a "spider" insert with 3, 4, or more legs equal in length to the radius of the tube, and in the center of which is a small bearing surface to receive the angle tip of the blade. This "spider" insert is carefully pushed down into the tube from its open end until it comes to the natural restriction in dimensions at the bend of the tube, where it is driven hard and "set" into the walls of the tube to act as the bearing for the rotating blade.

BRIEF DESCRIPTION OF THE ACCOMPANYING DRAWING

DETAILED DESCRIPTION OF THE ILLUSTRATED EMBODIMENTS

Figure 1:
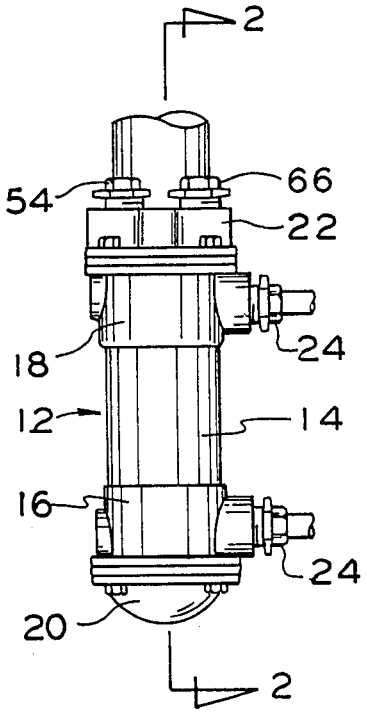
FIG. 1 is a partially schematic view of one form (called double pass) of the heat exchanger in accordance with the invention.

Turning now in detail to FIG. 1 of the drawing which illustrates a commercial shell-and-tube heat exchanger 12, this particular unit heat exchanger 12 is a 2-pass unit to illustrate the manner of operation with flow in either of the two possible directions. One of the two fluids involved enters and leaves the unit through "tube side" part having an inlet 54 and an outlet 66. The inlet 54 is functionally interchangeable with the outlet 66. At the opposite end of the body the flow of this fluid reverses in an end cap 20 and returns to leave the heat exchanger 12 at the same end that it entered. Although it is not essential, it is preferable both for the heat exchanger 12 in accordance with the invention and the known commercial heat exchanger that the hotter fluid flows in this tube circuit, and still more desirable if that is also the more viscous fluid. The second fluid is passed through the "shell-side", entering and leaving a cavity 56 around the tubes and inside a shell 14 through ports 24, 24. In this instance, it is immaterial which way the fluid flows, but it is important to note that in a single pass heat exchanger 12, where the tube side fluid flows straight through the heat exchanger 12 and leaves at the opposite end, that the shell-side fluid flows in the opposite direction from the tube side fluid. The shell-side ports 24 are mounted in hubs 16, 18 of the unit, which hold the heat exchanger 12 together and provide rigid mounting surfaces for bonnets 20, 22.

Figure 6:
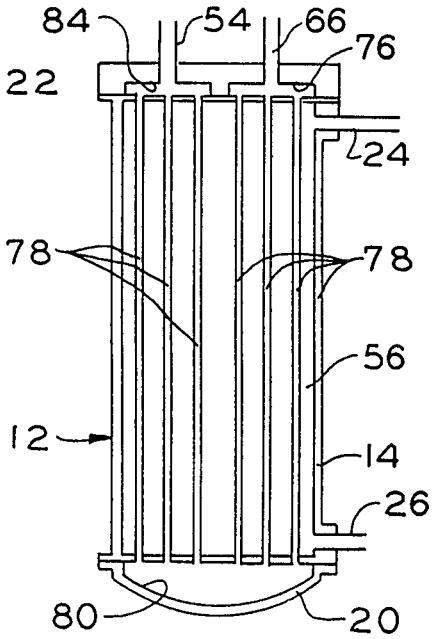
FIG. 6 is a schematic diagram of a double pipe heat exchanger with two possible methods of providing a bearing surface for the helical blade.

FIG. 6 depicts the flow path of the liquids through a double-pass heat exchanger 12. The one fluid (the hotter fluid preferably) enters the heat exchanger 12 through the pipe 66 into an inlet chamber 76 under the bonnet 22. The heat exchanger 12 is again somewhat schematically illustrated, and the one fluid (the hotter fluid) enters only a single tube 78 or through other tubes 78' to an outlet chamber 84 from which it exits the heat exchanger 12 through the outlet 54. During its passage through the tubes 78 and 78', the fluid is cooled through the tubes 78 and 78' by the other colder fluid disposed in the shell-side cavity 56 outside the tubes 78, 78'. The cooling fluid enters the shell-side cavity 56 through the inlet 24 and passes out the outlet 26 after being warmed.

Figure 5:
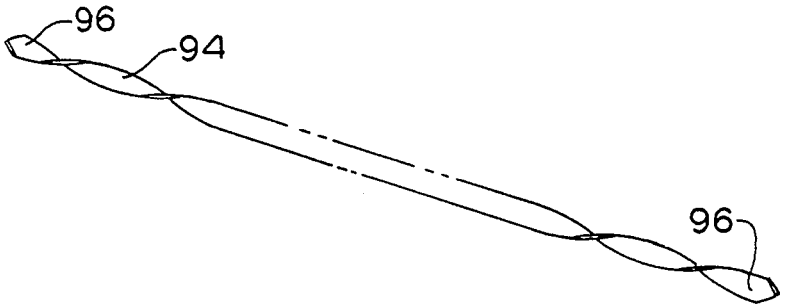
FIG. 5 is a perspective view of the helical blade utilized in the tubes of the heat exchanger, drawn to a scale slightly enlarged from that of FIG. 2 and showing, for simplicity, the blade partially in phantom line.
Figure 2:
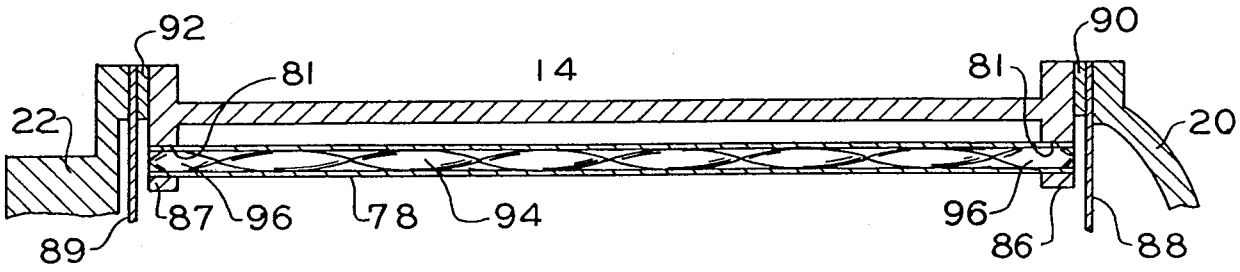
FIG. 2 is a diagrammatical, fragmentary elevational representation of a portion of the heat exchanger utilized in the module of FIG. 1, taken along line 2—2 thereof and drawn to a greatly enlarged scale.
Figure 4:
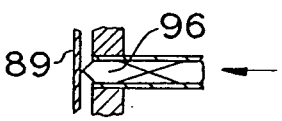
FIG. 4 is a view similar to FIG. 3, showing the left end of the tube with the blade shifted in that direction.
Figure 3:
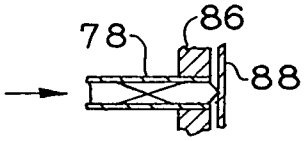
FIG. 3 is a further fragmented view of the right end portion of the tube illustrated in FIG. 2, showing the helical blade received therein and shifted axially to contact a bearing plate.

Basic features of the invention can best be appreciated by reference to FIG. 2, wherein the heat exchanger 12 is again somewhat schematically illustrated, and wherein only the single tube 78 (which may be in either the first or the second pass of a double pass heat exchanger) is depicted. The tube 78 is mounted within the shell 14 by a header plate or tubesheet 86, which has formed therein an aperture 87 within which the end of the tube 78 is engaged in a fluid tight fit. This may be achieved by roller expansion of the tube end portion. Fixed beneath the end cap 20 and the bonnet 22, at the opposite ends of the shell 14, are bearing plates 88, 89, respectively, each of which is spaced by a gasket 90, 92 a short distance from the corresponding end of the tube 78. A helical blade 94 (most clearly shown in FIG. 5) is disposed within the tube 78, and is of a length substantially equal thereto. Each end of the blade 94 is tapered to provide a pointed tip or end portion 96, which is aligned substantially on the central axis of the blade 94. Liquid flowing through the tube 78 will shift the blade 94 axially in the direction of liquid movement, causing one of its pointed tips 96 to bear upon the corresponding bearing plate 88, 89 and will rotate the blade 94, causing it to effectively mix a fluid layer along the inside surface of the wall of the tube 78. FIGS. 3 and 4 are illustrative of the two alternatives with the direction of liquid movement being as indicated by the arrows.

Figure 7:
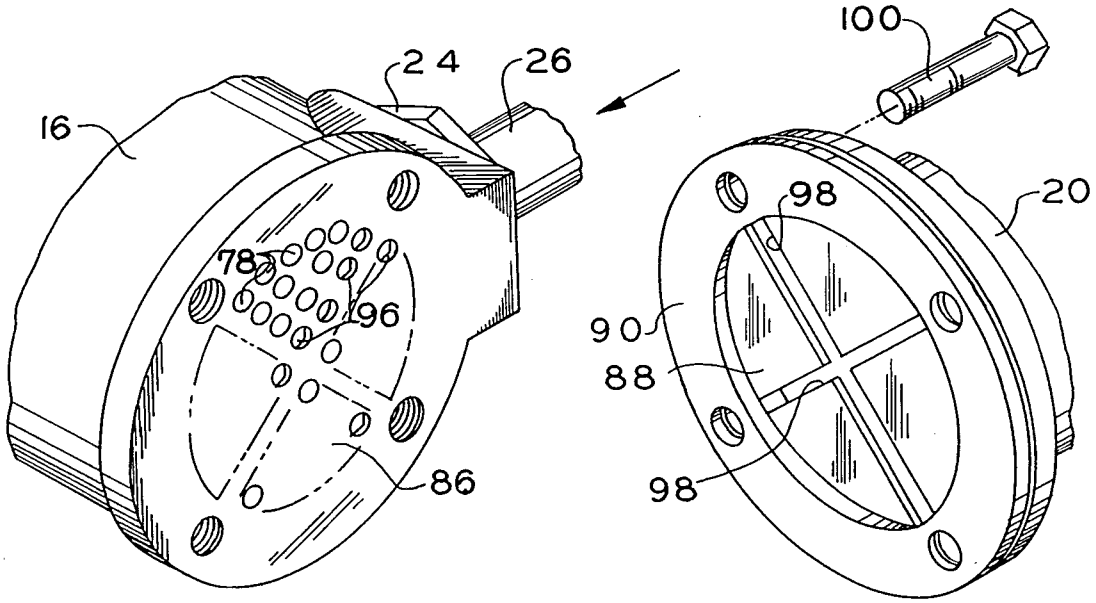
FIG. 7 is a fragmentary exploded perspective view of the outer end portion of the heat exchanger of FIG. 1, drawn to a scale greatly enlarged therefrom.
Figure 8:
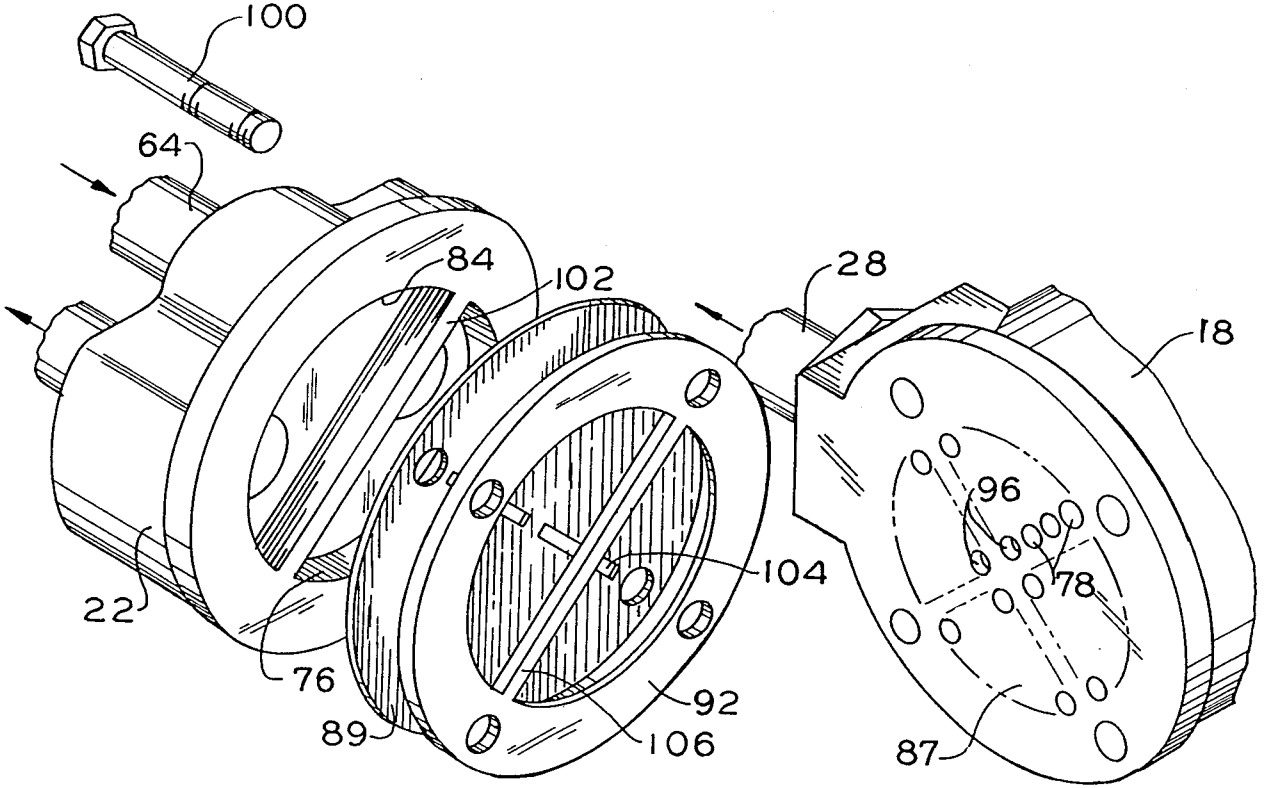
FIG. 8 is a view similar to FIG. 7, showing the opposite end portion of the heat exchanger.
Figure 9A:
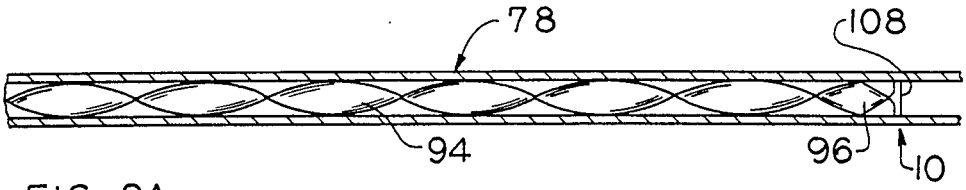
FIG. 9A is a schematic view of a bent tube liquid to air heat exchanger utilizing a spider support which is shown further in FIG. 9B.
Figure 9B:
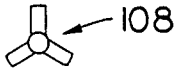
FIG. 9B is an elevational view showing the spider in greater detail.

As seen in FIGS. 7 and 8, the outer wall of hub portion 16 constitutes the tubesheet 86, in which is formed a multiplicity of apertures (not visible) each having engaged therein the end of one of tubes 78. Each of the tubes 78 has the helical blade 94 disposed therein (although some are removed for clarity of illustration) for operation in the manner described in connection with FIGS. 2 through 4. A gasket 92, in the assembled apparatus, is disposed against the face of the tubesheet 86, and the bearing plate 88 is interposed between it and the flange of the cap 20. As can be seen, the bearing plate 88 has two perpendicular, diametrically extending slots 98, which together define an X-shaped passageway for fluid flow between the tubes 78 through a common cavity 80 formed within the end cap 20. Four bolts 100 (only one being shown) are provided to secure the cap 20, the bearing plate 88 and the gasket 90 to the hub 16.

The hub 18, at the opposite end of the heat exchanger shell 14, is similarly constructed, with the tubesheet 87 mounting the opposite ends of the tubes 78 in fluid tight frictional engagement. The gasket 92 and the bearing plate 89 are secured under the bonnet 22, by bolts 100, and they are specifically configured to cooperate with a diametrically extending baffle element or rib 102 of the bonnet 22 to form the two chambers 76, 84 thereof. Thus, the bearing plate 89 has two aligned radial slot portions 104 formed therein, each of which permits communication with only one of the chambers 76, 84, with the solid portions of the plate 89 cooperating with the rib 102 to prevent leakage therebetween. The gasket 92, in turn, includes a diametrically extending element 106, which seals the two chambers 76, 84 against communication with one another on the opposite side of the plate 89, again to ensure that the streams entering and leaving the heat exchanger 12 do not mingle.

Although a double-pass heat exchanger is depicted in the drawings, it will be understood that the concepts of the present invention are not restricted to any particular flow configuration, and that the heat exchanger 12 may alternatively be of single-pass or multiple-pass design. Indeed, a particular advantage resulting from the bidirectional rotational capability of the helical blades 94, mounted as described, is that different flow patterns are readily achieved, either in the original manufacture of the heat exchanger 12 or in conversion of a standard unit. Thus, because the blades 94 are entirely free-floating within the tubes 78, 78', and require no mounting means other than the bearing plates 88, 89 they can simply be inserted into the tubes 78, 78' without regard for the direction in which flow is to occur.

The concepts of the invention are also applicable to heat exchangers of a wide range of sizes, although difficulties may be encountered if the unit is of excessive length, due to the increased tendency for the blades 94 to bind within the tubes 78, 78'. Normally the shell 14 will be about 1 to 5 feet in length and about 1 to 10 inches in diameter; while virtually any number of tubes 78, 78' can be employed, about 20 to 80 will be typical for most practical applications.

Figure 10:
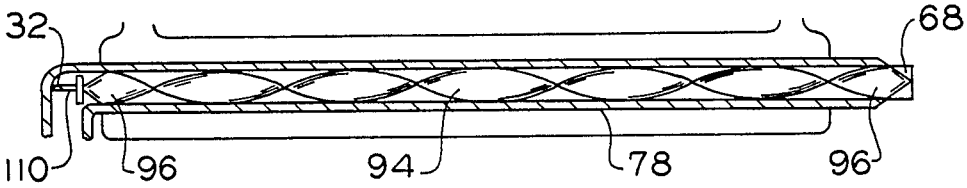
FIG. 10 is a schematic view illustrating other structure for mounting the film disrupting member in a double-pipe heat exchanger.
Figure 11:
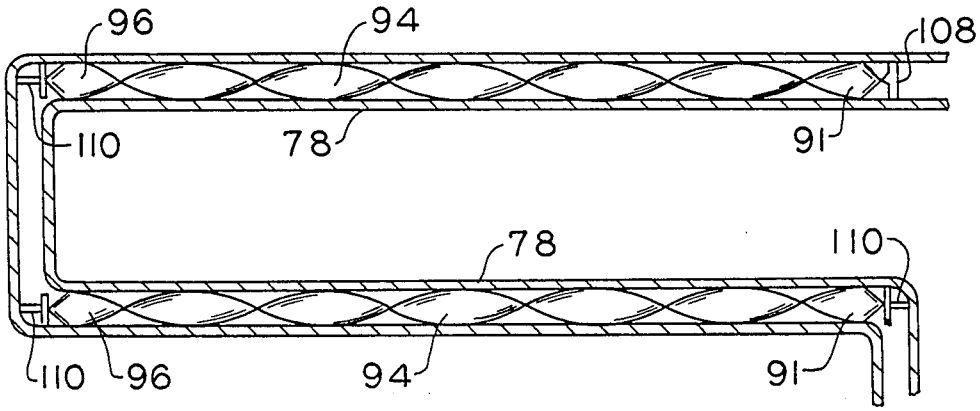
FIG. 11 is a schematic view illustrating the mounting film disrupting member in other tube shapes used in a liquid-to-air heat exchanger.
Figure 12:
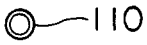
FIG. 12 is a fragmentary elevational view of the head of the bearing pin 110, shown in FIG. 11.

Referring now to FIGS. 9A–11 it will be seen that the invention is applicable to straight tube heat exchangers as well as to bent or U-tube heat exchangers. It will be recognized that the curved part of the tubes 78, 78' will not lend themselves to the blade 94 insert, but all straight portions of the tubes 78, 78' will. To allow for reversible flow, or flow in either direction, it is only necessary to provide a bearing point in each tube 78, 78' at an axial location slightly spaced from a bend. For example, there is shown a bearing point which can easily be supplied without significant restriction of the flow by providing a "spider" insert 108 shown in FIGS. 9A and 9B. The spider insert 108 may have 3, 4, or more radial extending legs having a length substantially equal to the radius of the tube 78, 78' with a centrally located bearing mounted at the central intersection, as best shown in FIG. 9B. Ordinarily the spider 108 will be substantially manufactured of the same metal as the heat exchanger pipes. In addition, for double pass heat exchangers, either a cap at the end of a straight flow section having a bearing surface mounted thereon or a bearing pin 110 mounted in a 90 degree elbow will suffice to provide a bearing point for the free-floating blades 94, as best shown in FIGS. 10 and 11. Even a fin-tube liquid-to-air heat exchanger, such as those typically found in an air conditioner with 180 degree U-bends at each end, can utilize an embodiment of the invention which includes pin-bearing inserts 110 at each 90 degree bend, as best seen in FIG. 11. These pin-bearing inserts 110 may include a pin extending in generally coaxial relation to the blade 94 and may have a head for supporting the blade 94.

Generally, each blade 94 will be a twisted strip of flat, thin metal. In order to effectively disrupt the fluid film on the inner wall of each tube 78, 78', the width of the blade 94 should be a least about nine-tenth of the diameter of the tube 78, 78' in which it is seated, and preferably it will be as wide as possible, consistent with free rotation under the conditions of the operation and adequate tolerances for expansion, distortion, manufacturing practicability, etc. It should be appreciated that, although the blade 94 might be said to "wipe" the wall of the tube 78, 78', the term "film disrupting" is more appropriate since the apparatus disrupts a film and does not touch the inner wall of the tube 78, 78'. This disruption occurs whether there is turbulent or laminar flow. This disruption maximizes heat transfer efficiency. The blade 94 will generally correspond in length to that of the tube 78, 78' in which it is seated, but it may be slightly longer or shorter, if desired. The blade 94 that is too short will, of course, leave a portion of the tube 78, 78' unwiped, thereby sacrificing some efficiency. Utilizing a blade 94 that is significantly longer than the tube 78, 78' will, on the other hand, expose the protruding portion to damage, with a consequential risk that the blade 94 will be rendered inoperative. Typically, the helical configuration will be such as to provide one full twist of the blade 94 for every unit of its length equal to 5 to 50 times its diameter.

A significant factor to be considered in the fabrication of the present heat exchangers concerns the rigidity of the blades 94 used, which, of course, is a function of the material of construction and its thickness; the blade 94 should be relatively rigid, but not unduly so. Thus, some flexibility is desirable to accommodate, without binding, the slight deviations from precise linearity and strict dimensional specifications that may be encountered in the manufacture of the tubes 78, 78' and the blades 94, permitting close tolerances between the blade 94 and the tube 78, 78', thereby affording optimum film disrupting action and, in turn, maximum heat transfer efficiency. On the other hand, the thickness must be adequate to provide the structural strength and toughness necessary for effective and durable operation.

In more specific terms, when the blade 94 is made of metal, it will generally be less than about 0.025 inches in cross-section. As indicated, however, this will depend upon the particular material involved; for example, a rigid steel blade may be about 0.007 to 0.16 inch thick, whereas one of brass would be in the range of about 0.009 to 0.018 inch in thickness; unannealed and annealed copper would typically be used in sections of about 0.01 and 0.02 inch, thick, respectively. Although it will generally be desirable to minimize the thickness of the blade 94, to provide maximum flexibility and minimum cost and weight, a practical lower limit does, of course, exist, beyond which the blade 94 would be too fragile for use. The lower limit for especially tough and rigid materials, such as spring steel, is 0.005 inch. A commensurate increase is necessary for less substantial materials.

As will be appreciated, it is important that the points provided on the end portions 96 of the blades 94 be centrally aligned with the axes of rotation, again to afford efficient operation and to prevent binding. The most facile manner of providing the pointed end portions 96 is simply to taper or sharpen the ends of the blades 94, particularly when they are made of metal, in the manner depicted in the drawings. Since hundreds of thousands of revolutions of the blade 94 are anticipated during its operating life, the individual angle at the tip 96 should be fairly great (no less than 90 degrees) to maximize the life thereof. Angles of 120 degrees to 150 degrees are desirable, but, aside from wear, are not critical to the function of the blade 94 or the invention.

While the bearing plates 88, 89 described in connection with the illustrated embodiment are simple and inexpensive, and therefore highly desirable, it will be evident to those skilled in the art that other types and configurations of bearing members 88, 89 may be substituted. A flat plate can be drilled with holes to permit fuid flow provided only that no hole is concentric with the tube 78. Moreover, although they are simply planar, slotted pieces, they may be modified in various respects, such as by forming surface recesses or cavities therein, in which the ends of the blades 94 are seated. The gaskets 90, 92 employed may similarly be modified, as long as they perform the sealing functions for which they are provided. It is, of course, important that the bearing plates or members 88, 89 be spaced a sufficient distance from the ends of the tubes 78, 78' to permit the free flow of liquid thereabout; generally, this will indicate an optimal spacing of approximately $\frac{1}{4}$ to $\frac{1}{2}$ inch between the plates 88, 89 and the tubes 78, 78'.

By way of specific example, a series of tests were carried out using a single-pass tube-and-shell heat exchanger, both with and without the helical blades 94. The unit was about three inches in diameter and 16 to 17 inches long, and contained 56 tubes 78, 78', 14 inches in length and with a 3/16 inch inside diameter, providing an effective heat transfer area of about 4.4 square feet. The blades 94 were made of 0.022 inch thick galvanized steel, and were constructed as illustrated in the drawing; each blade 94 was about the same length as the tube 78, 78' length and had a width that was slightly less than the tube 78, 78' diameter, providing a wall clearance of about 0.004 inch.

The heat exchange liquids used were water and a commercial synthetic hydrocarbon heat transfer fluid. In one series of tests, the synthetic product passed on the shell 14 side with the water on the tube 78, 78' side, and in a second series their paths were interchanged; but in all cases, the synthetic liquid was used to heat the water. Inlet and outlet temperatures of both liquids were noted at minute intervals following the commencement of each test, which was carried out with the liquids flowing at suitable practical rates.

From the foregoing, it is determined that, with the synthetic product on the tube 78, 78' side and the water on the shell 14 side (the preferred mode), a rate of thermal energy transfer to the water of 176 BTU/hour/degree Farenheit (the differential between the inlet temperatures of the two liquids) was realized with the unmodified heat exchanger. Using the blade-modified unit embodying the invention, a thermal energy transfer rate of 224 BTU/hour/degree was achieved. Transposing the liquids produced a rate of heat transfer in the conventional heat exchanger of 125 BTU/hour/degree, whereas the rate realized using the inventive unit was 145 BTU/hour/degree. These values indicate that the present heat exchanger enables increases of 27 percent, over the conventional unit, when the more viscous liquid (i.e., the synthetic product) is used on the tube side, and 16 percent when it passes on the shell side, respectively. Thus, not only is the general effectiveness of the present device demonstrated, but the foregoing results also show its particular value in handling viscous liquids.

Since heat exchange liquids are often referred to in the industry as "fluids", the terms "liquid" and "fluid" have been used herein as somewhat of a convenience in referring to the substances that flow, respectively, through the tubes 78, 78' and the shell 14 of the heat exchanger 12, more than for technical accuracy. While the substance flowing through the tubes 78, 78' will invariably be a liquid, that passing on the shell 14 side of the heat exchanger 12 may be either a liquid or a gas, such as when, for example, steam is utilized as the heating medium.

Thus, it can be seen that the present invention provides a novel tube-and-shell type double pipe or finned liquid-to-air type heat exchanger having means for preventing stagnation of the liquid flowing through the tubes 78, 78' thereof, to thereby maximize the efficiency of thermal energy transfer. Because of the film disrupting action of the blades 94 upon the tube 78, 78' walls, efficiencies of thermal energy transfer can be realized that are as much as fifty percent greater than are realized in the absence of such operation. These advantages are achieved in a manner that is simple, inexpensive and convenient, and in which maintenance requirements are minimized. The film disrupting effect occurs regardless of the direction of flow of the liquid through the tubes, and consequently installation of the unit is simplified.

Having thus described my invention, I claim:

1. In a heat exchanger, the combination comprising:

a shell having two ends, an inlet and an outlet for passage of a heat exchange fluid therethrough;

a tube mounted within said shell for external contact by the heat exchange fluid, and adapted for passage of a heat exchange liquid therethrough in physical isolation from the heat exchange fluid, said tube having a bend proximate to one end of said shell;

a generally helical blade disposed within said tube for free rotation and free axial movement, said blade having a laterally centered pointed portion on at least said one end thereof, and being of a diameter, relative to that of said tube, such as to cause said blade to pass in closely spaced relation to the inside surface of said tube during rotation; and a bearing member adjacent at least one end portion of said blade which comprises an elongated pin shaped member fixed to the corresponding bend of said tube and extending in generally coaxial relation to said tube, said bearing member having a planar head mounted on said elongated pin shaped member, said head being disposed in substantially normal relation to said pin shaped member and engaging and supporting said blade.

* * * * *